US009581931B2

(12) United States Patent
Yamada et al.

(10) Patent No.: US 9,581,931 B2
(45) Date of Patent: Feb. 28, 2017

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masaki Yamada, Mishima (JP); Sosuke Yamaguchi, Susono (JP); Kazuhiro Yamauchi, Suntou-gun (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/708,940

(22) Filed: May 11, 2015

(65) Prior Publication Data

US 2015/0331343 A1 Nov. 19, 2015

(30) Foreign Application Priority Data

May 16, 2014 (JP) ..... 2014-102654

(51) Int. Cl.
*G03G 5/02* (2006.01)
*G03G 15/02* (2006.01)
(Continued)

(52) U.S. Cl.
CPC ..... *G03G 15/08* (2013.01); *G03G 5/0528* (2013.01); *G03G 5/071* (2013.01); *G03G 15/02* (2013.01);
(Continued)

(58) Field of Classification Search
None
See application file for complete search history.

(56) References Cited

U.S. PATENT DOCUMENTS 5,925,477 A * 7/1999 Ledjeff ..... H01M 6/40 429/465
2012/0251171 A1* 10/2012 Muranaka ..... B32B 15/06 399/111

FOREIGN PATENT DOCUMENTS

JP 57-5047 A 1/1982
JP 4193193 B2 12/2008
JP 4392745 B2 1/2010

OTHER PUBLICATIONS

U.S. Appl. No. 14/715,477, filed May 18, 2015. Inventor: Sosuke Yamaguchi, et al.

(Continued)

*Primary Examiner* — Ramsey Zacharia
(74) *Attorney, Agent, or Firm* — Fitzpatrick, Cella, Harper & Scinto

(57) ABSTRACT

Provided is an electrophotographic member conducive to the formation of a high-quality electrophotographic image, the member showing a small increase in resistance even after long-term electrification under a high-temperature and high-humidity environment, and a process cartridge and an electrophotographic apparatus each including the electrophotographic member as a charging member and/or a developer carrying member. Specifically, provided is an electrophotographic member including a substrate and an electro-conductive layer, in which the electro-conductive layer contains a resin having a structure unit represented by the following structural formula (1) and a specific anion:

Structural formula (1)

(Continued)

in the structural formula (1), $R_1$ represents a hydrogen atom or a methyl group, and Z represents a cationic organic group.

6 Claims, 3 Drawing Sheets

(51) Int. Cl.
*G03G 15/08* (2006.01)
*G03G 5/07* (2006.01)
*G03G 5/05* (2006.01)
*G03G 5/10* (2006.01)

(52) U.S. Cl.
CPC ..... *G03G 5/107* (2013.01); *G03G 15/0233* (2013.01); *G03G 15/0818* (2013.01)

(56) References Cited

OTHER PUBLICATIONS

U.S. Appl. No. 14/708,981, filed May 11, 2015. Inventor: Masaki Yamada, et al.
U.S. Appl. No. 14/710,579, filed May 12, 2015. Inventor: Hideya Arimura, et al.
U.S. Appl. No. 14/709,155, filed May 12, 2015. Inventor: Satoru Nishioka, et al.

* cited by examiner

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present invention relates to an electrophotographic member to be used in an electrophotographic apparatus, and a process cartridge and an electrophotographic apparatus each including the electrophotographic member.

Description of the Related Art

In an electrophotographic apparatus (such as a copying machine, facsimile, or printer employing an electrophotographic system), an electrophotographic photosensitive member (hereinafter sometimes referred to as "photosensitive member") is charged by a charging member and exposed by a laser or the like, and as a result, an electrostatic latent image is formed on the photosensitive member. Next, toner in a developer container is applied onto a developer carrying member by a toner-supplying roller and a toner-regulating member. The electrostatic latent image on the photosensitive member is developed with the toner conveyed to a developing region by the developer carrying member at a portion in which the photosensitive member and the developer carrying member are in contact with, or close to, each other. After that, the toner on the photosensitive member is transferred onto recording paper by a transfer unit, and is fixed by heat and a pressure. In addition, the toner remaining on the photosensitive member is removed by a cleaning blade.

In the electrophotographic apparatus as an image-forming apparatus adopting the electrophotographic system, an electro-conductive member has been used in various applications, e.g., electro-conductive rollers such as a charging roller, a developing roller, and a transfer roller. The electrical resistance value of any such electro-conductive roller is controlled to from $10^5\Omega$ to $10^9\Omega$. In addition, an electro-conductive layer having added thereto an ionic electro-conductive agent such as a quaternary ammonium salt compound is provided for the adjustment of any such roller to such electro-conductivity.

An ionic electro-conductive member obtained by adding the ionic electro-conductive agent can reduce the non-uniformity of the electrical resistance value resulting from non-uniform dispersion of the electro-conductive agent as compared to an electronic electro-conductive member. Accordingly, a low-resistance site hardly occurs in the electro-conductive layer in a local manner.

Meanwhile, the ionic electro-conductive agent such as a quaternary ammonium salt or an alkali metal salt may bleed to the surface of an electro-conductive roller (hereinafter referred to as "bleeding"). As a result, a change in outer diameter dimension of the electro-conductive roller, an increase in property by which dirt adheres to the surface of the electro-conductive roller, and the contamination of the surface of any other member to be brought into contact with the electro-conductive roller may occur. In addition, a desired resistance value may not be obtained under a high-temperature and high-humidity environment or a low-temperature and low-humidity environment because the resistance of the roller is liable to fluctuate depending on an environment.

Japanese Patent No. 4193193 discloses a method involving using an ionic liquid having a specific chemical structure as a method for the suppression of the bleeding of the ionic electro-conductive agent and the suppression of the fluctuation in resistance with an environment. In addition, Japanese Patent No. 4392745 discloses a method involving using an ionic liquid having specific physical properties.

SUMMARY OF THE INVENTION

The present invention is directed to providing an electrophotographic member conducive to the formation of a high-quality electrophotographic image, the member showing a small increase in resistance even after long-term electrification under a high-temperature and high-humidity environment.

In addition, the present invention is directed to providing an electrophotographic apparatus that can stably output a high-quality electrophotographic image and a process cartridge to be used in the apparatus.

According to one aspect of the present invention, there is provided an electrophotographic member, including:

a substrate; and an electro-conductive layer, in which the electro-conductive layer contains a resin having a structure unit represented by the following structural formula (1), and at least one anion selected from the group consisting of a fluorinated sulfonylimide anion, a fluorinated sulfonylmethide anion, a fluorinated sulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato) borate anion.

Structural formula (1)

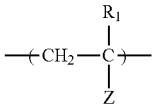

In the structural formula (1), $R_1$ represents a hydrogen atom or a methyl group, and Z represents a cationic organic group.

According to another aspect of the present invention, there is provided a process cartridge, which is removably mounted onto a main body of an electrophotographic apparatus, the process cartridge including at least:

a charging member; and a developer carrying member, in which at least one of the charging member or the developer carrying member includes the above-mentioned electrophotographic member.

According to further aspect of the present invention, there is provided an electrophotographic apparatus, including:

an electrophotographic photosensitive member;

a charging member; and a developer carrying member, in which at least one of the charging member or the developer carrying member includes the above-mentioned electrophotographic member.

According to the present invention, the electrophotographic member conducive to the formation of a high-quality electrophotographic image, the member showing a small increase in resistance due to long-term electrification under a high-temperature and high-humidity environment, can be provided by combining a resin having a cationic organic group and a specific anion.

In addition, according to the present invention, the process cartridge and electrophotographic apparatus that can stably form a high-quality electrophotographic image can be provided.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In recent years, an electrophotographic apparatus has been required to be capable of maintaining high image quality and high durability even under an additionally severe environment.

An electro-conductive layer containing an ionic liquid is excellent in suppression of a resistance fluctuation due to a severe environment, but the resistance of the electro-conductive layer may increase upon long-term electrification.

Therefore, according to investigations made by the inventors of the present invention, when each of electro-conductive rollers according to Japanese Patent No. 4193193 and Japanese Patent No. 4392745 each including a surface layer formed of a resin containing an ionic liquid is electrified particularly under high temperature and high humidity for a long time period, a harmful effect on an image may occur on an electrophotographic image owing to an increase in resistance thereof.

In view of the foregoing, the inventors of the present invention have made extensive investigations for obtaining an electrophotographic member conducive to the formation of a high-quality electrophotographic image, the member showing a small increase in resistance even after long-term electrification under a high-temperature and high-humidity environment. As a result, the inventors have found that the increase in resistance due to the electrification under the high-temperature and high-humidity environment can be suppressed by combining a resin having a cationic organic group and a specific anion.

Figure 1A:
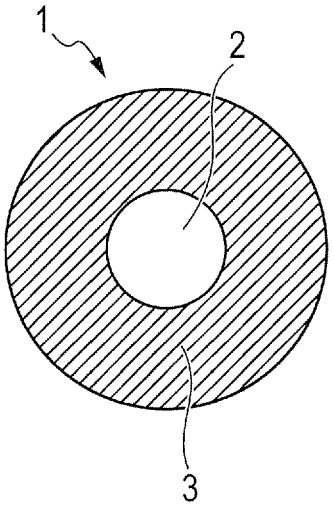
FIG. 1A and FIG. 1B are each a schematic view for illustrating an example of an electrophotographic member according to the present invention.
Figure 1B:
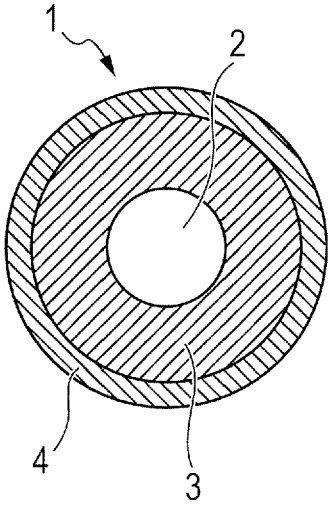

FIG. 1A and FIG. 1B are illustrations of an embodiment when an electrophotographic member according to the present invention is used as an electro-conductive roller. As illustrated in, for example, FIG. 1A, an electro-conductive roller 1 can include an electro-conductive mandrel 2 as a substrate according to the present invention and an elastic layer 3 provided on the outer periphery thereof. In this case, the elastic layer 3 is an electro-conductive layer according to the present invention and contains a resin having a structure unit represented by the following structural formula (1). Alternatively, the electro-conductive roller 1 may be such that a surface layer 4 is formed on the outer periphery of the elastic layer 3 as illustrated in FIG. 1B. In this case, at least one of the elastic layer 3 or the surface layer 4 contains the resin having a structure unit represented by the structural formula (1). In this case, the surface layer 4 preferably contains the resin having a structure unit represented by the structural formula (1).

Structural formula (1)

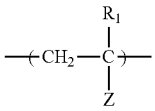

In the structural formula (1), $R_1$ represents a hydrogen atom or a methyl group, and Z represents a cationic organic group.

<Mandrel>

The mandrel 2 as the substrate according to the present invention has a solid columnar shape or hollow cylindrical shape so as to function as an electrode and support member for the electro-conductive roller 1. The mandrel 2 is formed of an electro-conductive material such as: a metal or an alloy like aluminum, a copper alloy, or stainless steel; iron subjected to plating treatment with chromium or nickel; or a synthetic resin having electro-conductivity.

<Elastic Layer>

The elastic layer 3 imparts, to the electro-conductive roller, elasticity needed for forming a predetermined nip in an abutting portion between the electro-conductive roller and the photosensitive member.

It is generally preferred that the elastic layer 3 be formed of a molded product of a rubber material. Examples of the rubber material include an ethylene-propylene-diene copolymerized rubber, an acrylonitrile-butadiene rubber, a chloroprene rubber, a natural rubber, an isoprene rubber, a styrene-butadiene rubber, a fluororubber, a silicone rubber, an epichlorohydrin rubber, and a urethane rubber. One kind of those materials may be used alone, or two or more kinds thereof may be used as a mixture.

Of those, the silicone rubber is particularly preferred from the viewpoints of compression set and flexibility. The silicone rubber is, for example, a cured product of an addition-curable silicone rubber.

Various additives such as an electro-conductivity-imparting agent, a non-electro-conductive filler, a crosslinking agent, and a catalyst are each appropriately blended into the elastic layer 3. Fine particles of carbon black, of an electro-conductive metal such as aluminum or copper, or of an electro-conductive metal oxide such as tin oxide or titanium oxide can be used as the electro-conductivity-imparting agent. Of those, carbon black is particularly preferred because the carbon black is relatively easily available and provides good electro-conductivity. When the carbon black is used as the electro-conductivity-imparting agent, the carbon black is blended in an amount of from 2 parts by mass to 50 parts by mass with respect to 100 parts by mass of the rubber in the rubber material. Examples of the non-electro-conductive filler include silica, quartz powder, titanium oxide, and calcium carbonate. Examples of the crosslinking agent include di-t-butyl peroxide, 2,5-dimethyl-2,5-di(t-butylperoxy)hexane, and dicumyl peroxide.

<Surface Layer>

In the present invention, the elastic layer 3 and/or the surface layer 4 contains the resin having a structure unit represented by the structural formula (1) and at least one anion selected from the group consisting of a fluorinated sulfonylimide anion, a fluorinated sulfonylmethide anion, a fluorinated sulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion.

In the present invention, the surface layer 4 preferably contains a binder resin in addition to the resin having a structure unit represented by the structural formula (1). The binder resin functions as a carrier for the resin having a structure unit represented by the structural formula (1) and a filler.

Specific examples of the binder resin include a polyurethane resin, a polyester resin, a polyether resin, an acrylic resin, an epoxy resin, and an amino resin such as a melamine resin. In particular, a polyurethane resin and a melamine resin are preferred from the viewpoints of coat strength and toner chargeability. Of those, a thermosetting polyether polyurethane resin and a polyester polyurethane resin are suitably used because of having flexibility in addition to the strength and the chargeability. Those thermosetting polyurethane resins are each obtained through a reaction of a known polyether polyol or polyester polyol and an isocyanate compound.

Examples of the polyether polyol include polyethylene glycol, polypropylene glycol, and polytetramethylene glycol. In addition, examples of the polyester polyol include polyester polyols each obtained through a condensation reaction of a diol component such as 1,4-butanediol, 3-methyl-1,4-pentanediol, or neopentyl glycol, a triol component such as trimethylolpropane, and a dicarboxylic acid such as adipic acid, phthalic anhydride, terephthalic acid, or hexahydroxyphthalic acid. The polyol component may be formed in advance into a prepolymer through chain extension with an isocyanate such as 2,4-tolylene diisocyanate (TDI), 4,4'-diphenylmethane diisocyanate (MDI), or isophorone diisocyanate (IPDI) as required.

The isocyanate compound to be caused to react with the polyol component is not particularly limited and there may be used: aliphatic polyisocyanates such as ethylene diisocyante and 1,6-hexamethylene diisocyante (HDI); alicyclic polyisocyanates such as isophorone diisocyanate (IPDI), cyclohexane 1,3-diisocyanate, and cyclohexane 1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and copolymers thereof, isocyanurates thereof, TMP adducts thereof, biuret compounds thereof, and blocked compounds thereof. Of those, there are more suitably used aromatic isocyanates such as tolylene diisocyanate, diphenylmethane diisocyanate, and polymeric diphenylmethane diisocyanate.

The mixing ratio of the isocyanate compound to be caused to react with the polyol component in terms of an isocyanate group ratio preferably falls within the range of from 1.0 to 2.0 with respect to 1.0 of a hydroxyl group of each of the polyol component and the compound because unreacted components can be suppressed from remaining.

In addition to a thermal curing reaction involving using the isocyanate compound, a compound having a vinyl group or acryloyl group introduced to a terminal thereof can be subjected to a curing reaction with UV light or an electron beam instead of the polyol.

In a curing system involving using UV light or an electron beam, a curing reaction can be performed within a short time period as compared to a curing system involving using an isocyanate.

The inventors of the present invention have assumed the reason why an effect of the present invention is exhibited by incorporating the resin having a structure unit represented by the structural formula (1) and the anion to be as described below.

When a monomolecular ionic electro-conductive agent is added to a resin, an ion component can move in the network structure of the resin. When electrification is performed in the state, a cation moves to a negative electrode side and an anion moves to a positive electrode side, whereby the resin shows electro-conductivity. Under a high-temperature environment, the molecular motion of the resin is active and hence the mobility of each ion becomes additionally high. Accordingly, the movement of the ions abruptly occurs, and as the polarization of the cation and the anion progresses, the resistance of the resin increases (the so-called electrification deterioration).

In contrast, in the case of the resin having a structure unit represented by the structural formula (1) according to the present invention, the cationic organic group is one component constituting the polymer. Accordingly, even under a high-temperature environment, the movement of a cation is suppressed by the entanglement of a polymer chain and hence the abrupt movement of the cation due to electrification hardly occurs.

Further, a plurality of cations bonded to the polymer chain and anions forming ion pairs with the cations agglomerate by virtue of a difference in polarity between a main chain polymer and the binder resin to establish a form in which the cations and the anions locally crowd. It is assumed from the foregoing that the plurality of cations can exhibit ionic interactions on the anions and hence the abrupt movement of a large part of the anions upon electrification is also suppressed.

However, in the case where the anions are halogen anions such as a chloride ion and a bromide ion, or strong acid anions such as a sulfate anion and a nitrate anion, a resistance increase-suppressing effect may not be obtained even when the polymerized cations are used. The reason for the foregoing is assumed to be as described below.

A halogen anion, a sulfate anion, or a nitrate anion has low chemical stability, and is hence liable to be reduced by, for example, moisture in the resin or an alkali metal ion to be mixed in a production process for the resin. In addition, "the anions are reduced" in the present invention means that the anions lose their charges.

Accordingly, a small portion of the anions are assumed to be reduced under a high-humidity environment in some cases. When the anions are reduced to lose their charges, their interactions with the polymerized cations disappear and hence the resultant components diffuse in the resin. Even when the components become anions again after the diffusion, the anions are present at positions distant from the polymerized cations and hence substantially no interactions with the cations may occur. A small portion of the entirety of the anions are assumed to be reduced, but when electrification is performed for a long time period under a high-temperature and high-humidity environment, it is assumed that the diffusion of the anions is gradually advanced by the small portion, and as a result, the abrupt movement of the anions cannot be suppressed.

In contrast, the anion according to the present invention has the following feature: the anion is extremely chemically stable as an anion as compared to a halogen anion, a sulfate anion, and a nitrate anion, and hence the anion is hardly reduced by a water molecule or the like. The "chemical stability as an anion" is not unambiguously determined by the strength of acidity and may be derived from the chemical structure of the anion. For example, it has been known that trifluoromethanesulfonic acid as one of the anions according to the present invention is substantially free of being reduced, though its acid strength is 1,000 times as high as that of nitric acid. The anion according to the present invention is extremely chemically stable, and hence it is assumed that the diffusion by the reduction of a small portion of the anions and the disappearance of the interactions with the cations in association with the diffusion hardly occur, and the resistance increase-suppressing effect is obtained.

Therefore, the following elements are needed for exhibiting the effect of the present invention: 1. cations that are suppressed from diffusing in the resin by polymerization and hence locally crowd; and 2. anions each having an extremely chemically stable chemical structure and hardly reduced by moisture or any other cation. It is assumed that only a combination of the resin having a structure unit represented by the structural formula (1) and the anion according to the present invention allows the anion to receive ionic interactions from the plurality of cations and hence suppresses an increase in resistance of the resin due to abrupt polarization.

The resin having a structure unit represented by the structural formula (1) is obtained by polymerizing a cationic monomer having a polymerizable functional group such as a vinyl group, an allyl group, an acryloyl group, or a methacryloyl group, and is also obtained by polymerizing a polymerizable monomer having a tertiary amino group or an imino skeleton, and subjecting the resultant to a quaternization reaction.

Specific examples of the cationic organic group Z in the partial structure of the structural formula (1) include a quaternary ammonium group, a sulfonium group, a phosphonium group, and a cationic nitrogen-containing heterocyclic group. Examples of the cationic nitrogen-containing heterocyclic group include a piperidinium group, a pyrrolidinium group, a morpholinium group, an oxazolium group, a pyridinium group, a pyrimidinium group, a pyrazinium group, a pyridazinium group, an imidazolium group, a pyrazolium group, a triazolium group, and hydrides and derivatives thereof.

Examples of the polymerizable monomer having a quaternary ammonium group include a trimethyl-(meth)acroyloxyethylammonium halide, a trimethyl-(meth)acroyloxymethylammonium halide, a dimethyl-(meth) acroyloxyethylammonium halide, a triethyl-(meth) acroyloxyethylammonium halide, a dimethyloctyl-(meth) acroyloxyethylammonium halide, a diethyloctyl-(meth) acroyloxyethylammonium halide, a dimethyllauryl-(meth) acroyloxyethylammonium halide, and a tributyl-(meth) acroyloxyethylammonium halide.

It should be noted that the term "(meth)acrylate/(meth) acroyloxy" used herein refers to a methacrylate/methacroyloxy or an acrylate/acroyloxy.

Examples of the polymerizable monomer having a tertiary amino group include N,N-dimethylaminomethyl(meth)acrylate, N,N-diethylaminomethyl(meth)acrylate, N,N-dimethylaminoethyl(meth)acrylate, N,N-diethylaminoethyl(meth) acrylate, N,N-dimethylaminopropyl(meth)acrylate, N,N-diethylaminopropyl(meth)acrylate, N,N-dimethylaminobutyl(meth)acrylate, N,N-diethylaminobutyl (meth)acrylate, 1-acryloylpyrrolidine, 2-(1-pyrrolidinyl) ethyl (meth)acrylate, 1-methyl-2-(1-pyrrolidinyl)ethyl (meth)acrylate, and acryloylmorpholine.

Examples of the polymerizable monomer having an imino skeleton include 3-vinylpyridine, 4-vinylpyridine, 2-vinylpyridine, 1-vinylimidazole, 1-allylimidazole, 1-(2-methacryloyloxyethyl)imidazole, and 3-vinylpiperidine.

Those polymerizable monomers each having a tertiary amino group or an imino skeleton may be polymerized, and then subjected to a known quaternization reaction, for example, a quaternization reaction using an alkyl halide to form a quaternary ammonium group.

A resin having at least one selected from the group consisting of an imidazolium structure and a pyridinium structure in the partial structure of the structural formula (1) is particularly preferred because the resin has high electroconductivity and shows a small increase in resistance at the time of electrification.

A plurality of different monomers each having such cationic organic group Z as described above can be used in combination. The compatibility of the resin with the binder resin can be regulated by, for example, using (meth)acrylic acid having a trimethylaminoethyl group having relatively high polarity and a vinyl compound having an alkyl-substituted pyridinium group having relatively low polarity while changing their mixing ratio.

The resin having a structure unit represented by the structural formula (1) may be a resin obtained by copolymerizing a monomer free of any structure represented by the structural formula (1) and a monomer containing a structure represented by the structural formula (1) as required. Examples of the monomer free of any structure represented by the structural formula (1) include the following monomers. It should be noted that in the following examples, the acrylate and the methacrylate are referred to as (meth) acrylate:

methyl (meth)acrylate, ethyl (meth)acrylate, n-propyl(meth) acrylate, n-butyl (meth)acrylate, isopropyl(meth)acrylate, sec-butyl (meth)acrylate, isobutyl(meth)acrylate, tert-butyl (meth)acrylate, n-amyl(meth)acrylate, n-hexyl(meth)acrylate, cyclohexyl(meth)acrylate, 2-ethylhexyl(meth)acrylate, n-octyl(meth)acrylate, iso-octyl(meth)acrylate, n-nonyl (meth)acrylate, n-lauryl(meth)acrylate, n-tridecyl(meth) acrylate, n-stearyl(meth)acrylate, isobornyl(meth)acrylate, cyclohexyl(meth)acrylate, 2-hydroxyethyl(meth)acrylate, and 4-hydroxybutyl(meth)acrylate; styrene, 4-(or 3-)methylstyrene, 4-(or 3-)ethylstyrene, 4-(or 3-)n-propylstyrene, 4-(or 3-)n-butylstyrene, 4-(or 3-)isopropylstyrene, 4-(or 3-)sec-butylstyrene, 4-(or 3-)isobutylstyrene, and 4-(or 3-)tert-butylstyrene; and benzyl (meth)acrylate, 4-(or 3-)methylbenzyl(meth)acrylate, 4-(or 3-)ethylbenzyl(meth) acrylate, 4-(or 3-)n-propylbenzyl(meth)acrylate, 4-(or 3-)n-butylbenzyl(meth)acrylate, 4-(or 3-)isopropylbenzyl(meth) acrylate, 4-(or 3-)sec-butylbenzyl(meth)acrylate, 4-(or 3-)isobutylbenzyl(meth)acrylate, and 4-(or 3-)tert-butylbenzyl(meth)acrylate.

Of those, a resin obtained by copolymerizing a hydroxy group-containing monomer such as 2-hydroxyethyl(meth) acrylate or 4-hydroxybutyl(meth)acrylate and a monomer containing the cationic organic group Z is particularly preferred because bleeding can be additionally suppressed by causing the resin to react with an isocyanate group or a melamine resin.

The molar content of the monomer containing the cationic organic group Z is preferably 5 mol % or more from the viewpoint of imparting electro-conductivity when the monomer containing the cationic organic group Z and a monomer free of the cationic organic group Z described above are copolymerized.

In the present invention, as an anion that forms a pair with the cationic organic group Z, there is given, for example, at least one anion selected from the group consisting of a fluorinated sulfonylimide anion, a fluorinated sulfonylmethide anion, a fluorinated sulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato) borate anion.

Examples of the fluorinated sulfonylimide anion include a trifluoromethanesulfonylimide anion, a perfluoroethylsulfonylimide anion, a perfluoropropylsulfonylimide anion, a perfluorobutylsulfonylimide anion, a perfluoropentylsulfonylimide anion, a perfluorohexylsulfonylimide anion, a perfluorooctylsulfonylimide anion, a fluorosulfonylimide anion, and a cyclic anion such as N,N-hexafluoropropane-1,3-disulfonimide.

Examples of the fluorinated sulfonylmethide anion include a trifluoromethanesulfonylmethide anion, a perfluoroethylsulfonylmethide anion, a perfluoropropylsulfonylmethide anion, a perfluorobutylsulfonylmethide anion, a perfluoropentylsulfonylmethide anion, a perfluorohexylsulfonylmethide anion, and a perfluorooctylsulfonylmethide anion.

Examples of the fluorinated sulfonate anion include a trifluoromethanesulfonate anion, a fluoromethanesulfonate anion, a perfluoroethylsulfonate anion, a perfluoropropylsulfonate anion, a perfluorobutylsulfonate anion, a perfluoropentylsulfonate anion, a perfluorohexylsulfonate anion, and a perfluorooctylsulfonate anion.

Examples of the fluorinated carboxylate anion include a trifluoroacetate anion, a perfluoropropionate anion, a perfluorobutyrate anion, a perfluorovalerate anion, and a perfluorocaprate anion.

Examples of the fluorinated borate anion include a tetrafluoroborate anion, a trifluoromethyltrifluoroborate anion, and a perfluoroethyltrifluoroborate anion.

Examples of the fluorinated phosphate anion include a hexafluorophosphate anion, a tris-trifluoromethyl-trifluorophosphate anion, and a tris-perfluoroethyl-trifluorophosphate anion.

Examples of the fluorinated arsenate anion include a hexafluoroarsenate anion and a trifluoromethyl-pentafluoroarsenate anion.

Examples of the fluorinated antimonate anion include a hexafluoroantimonate anion and a trifluoromethyl-pentafluoroantimonate anion.

Examples of the other anion include a dicyanamide anion and a bis(oxalato)borate anion.

The ionic group-containing resin according to the present invention can be obtained by performing the ion exchange reaction of the resin containing a cationic organic group with an alkali metal salt of the anion or an acid reagent.

The content of the resin having a structure unit represented by the structural formula (1) is preferably 1 part by mass or more and 10 parts by mass or less with respect to 100 parts by mass of the binder resin from the viewpoints of electro-conductivity and the suppression of a resistance fluctuation due to electrification.

The number-average molecular weight of the resin having a structure unit represented by the structural formula (1) is preferably 2,000 or more and 70,000 or less from both the viewpoints of a suppressing effect on a resistance increase at the time of electrification and compatibility. When the number-average molecular weight is 2,000 or more, the resin is excellent in suppression of a resistance fluctuation at the time of the electrification, and when the number-average molecular weight is 70,000 or less, the resin is excellent in compatibility with the binder resin.

The surface layer 4 may contain a non-electro-conductive filler such as silica, a quartz powder, titanium oxide, zinc oxide, or calcium carbonate as required. When a method involving coating the elastic layer with a paint is adopted in the formation of the surface layer, the non-electro-conductive filler can be caused to serve as a film-forming auxiliary by adding the non-electro-conductive filler to the paint. The content of the non-electro-conductive filler is preferably 10 mass % or more and 30 mass % or less with respect to 100 parts by mass of all components of the resins for forming the surface layer, i.e., the binder resin and the resin having a structure unit represented by the structural formula (1).

In addition, the surface layer 4 may contain an electro-conductive filler as required to the extent that the effect of the present invention is not inhibited. Fine particles of carbon black, of an electro-conductive metal such as aluminum or copper, or of an electro-conductive metal oxide such as zinc oxide, tin oxide, or titanium oxide can be used as the electro-conductive filler. Of those, carbon black is particularly preferred because the carbon black is relatively easily available and from the viewpoints of an electro-conductivity-imparting property and a reinforcing property.

Upon use of the electro-conductive roller as a developing roller or a charging roller, when the surface roughness of the developing roller or the charging roller is needed, fine particles for roughness control may be added to the surface layer 4. The volume-average particle diameter of the fine particles for roughness control is preferably from 3 μm to 20 μm. In addition, the addition amount of the particles to be added to the surface layer 4 is preferably from 1 part by mass to 50 parts by mass with respect to 100 parts by mass of the resin solid content of the surface layer 4. Fine particles of a polyurethane resin, a polyester resin, a polyether resin, a polyamide resin, an acrylic resin, or a phenol resin can be used as the fine particles for roughness control.

A method of forming the surface layer 4 is not particularly limited, but examples thereof include a spray method with a paint, a dip coating method, and a roll coating method. Such dip coating method involving causing a paint to overflow from the upper end of a dipping tank as described in Japanese Patent Application Laid-Open No. S57-5047 is simple and excellent in production stability as the method of forming the surface layer.

The electrophotographic member of the present invention is applicable to any one of, for example, a noncontact-type developing apparatus and a contact-type developing apparatus each using a magnetic one-component developer or a nonmagnetic one-component developer, and a developing apparatus using a two-component developer.

Figure 2:
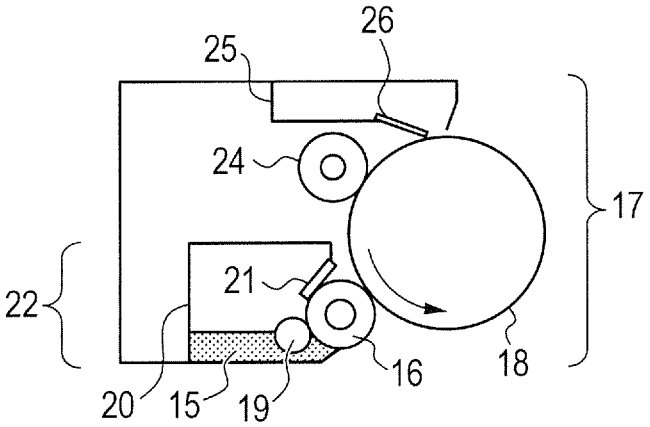
FIG. 2 is a schematic construction view for illustrating an example of a process cartridge according to the present invention.

FIG. 2 is a sectional view for illustrating an example of a process cartridge in which the electrophotographic member according to the present invention is used as one, or each of both, of a charging roller 24 and a developing roller 16. A process cartridge 17 illustrated in FIG. 2 is obtained by integrating a developing apparatus 22 including the developing roller 16 as a developer carrying member, an electrophotographic photosensitive member 18, a cleaning blade 26, a waste toner-storing container 25, and the charging roller 24 as a charging member, and is removably mounted onto the main body of an electrophotographic apparatus. The developing apparatus 22 includes a toner container 20 and a toner 15 is loaded into the toner container 20. The toner 15 in the toner container 20 is supplied to the surface of the developing roller 16 by a toner-supplying roller 19, and a layer of the toner 15 having a predetermined thickness is formed on the surface of the developing roller 16 by a developing blade 21.

Figure 3:
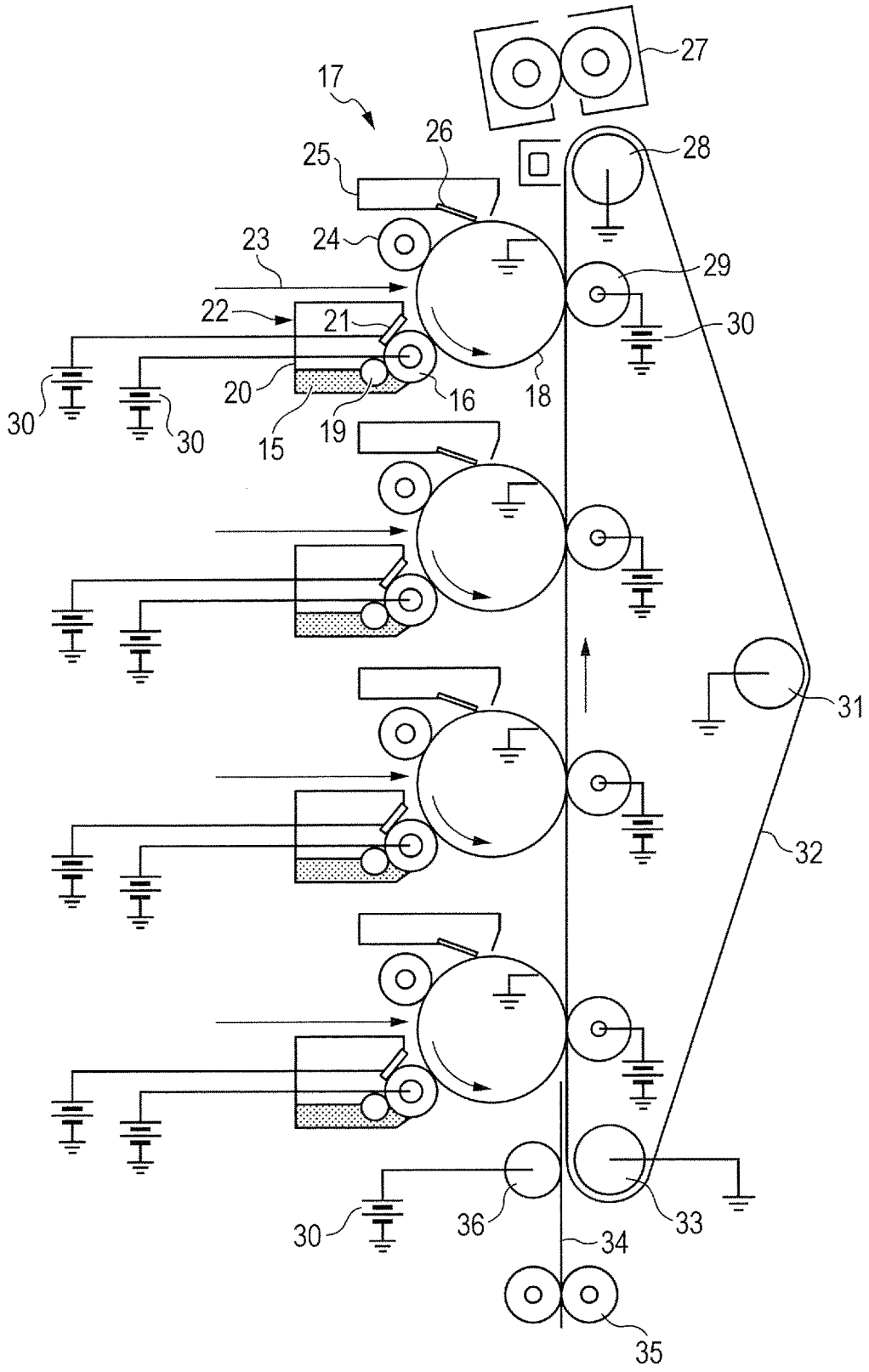
FIG. 3 is a schematic construction view for illustrating an example of an electrophotographic apparatus according to the present invention.

FIG. 3 is a sectional view for illustrating an example of an electrophotographic apparatus in which the electrophotographic member according to the present invention is used as one, or each of both, of the charging roller 24 and the developing roller 16. Removably mounted onto the electrophotographic apparatus of FIG. 3 is the developing apparatus 22 formed of the developing roller 16, the toner-supplying roller 19, the toner container 20, the toner 15, and the developing blade 21. Also removably mounted thereonto is the process cartridge 17 formed of the electrophotographic photosensitive member 18, the cleaning blade 26, the waste toner-storing container 25, and the charging roller 24. In addition, the electrophotographic photosensitive member 18, the cleaning blade 26, the waste toner-storing container 25, and the charging roller 24 may be disposed in the main body of the electrophotographic apparatus. The electrophotographic photosensitive member 18 rotates in a direction indicated by an arrow. The surface of the electrophotographic photosensitive member 18 is uniformly charged by the charging roller 24 for subjecting the electrophotographic photosensitive member 18 to a charging treatment, and an electrostatic latent image is formed on the surface by laser light 23 as an exposing unit for writing the electrostatic latent image on the photosensitive member 18. The toner 15 is applied to the electrostatic latent image by the developing apparatus 22, which is placed so as to be brought into contact with the electrophotographic photosensitive member 18, to develop the image, whereby the image is visualized as a toner image.

The development performed here is the so-called reversal development in which the toner image is formed in an exposure portion. The visualized toner image on the electrophotographic photosensitive member 18 is transferred onto paper 34 as a recording medium by a transfer roller 29 as a transfer member. The paper 34 is fed into the apparatus through a sheet-feeding roller 35 and an adsorption roller 36, and is conveyed to a gap between the electrophotographic photosensitive member 18 and the transfer roller 29 by an endless belt-shaped transfer conveyance belt 32. The transfer conveyance belt 32 is operated by a driven roller 33, a driver roller 28, and a tension roller 31. A predetermined voltage is applied from a bias power source 30 to each of the transfer roller 29 and the adsorption roller 36. The paper 34 onto which the toner image has been transferred is subjected to a fixation treatment by a fixing apparatus 27 and discharged to the outside of the apparatus. Thus, a printing operation is completed.

Meanwhile, transfer residual toner remaining on the electrophotographic photosensitive member 18 without being transferred is scraped off by the cleaning blade 26 as a cleaning member for cleaning the surface of the photosensitive member, and is stored in the waste toner-storing container 25. The cleaned electrophotographic photosensitive member 18 repeatedly performs the above-mentioned action.

The developing apparatus 22 includes: the toner container 20 storing the toner as a one-component developer; and the developing roller as a developer carrying member that is positioned in an opening portion extending in a lengthwise direction in the toner container 20 and is placed so as to face the electrophotographic photosensitive member 18. The developing apparatus 22 is configured to develop and visualize the electrostatic latent image on the electrophotographic photosensitive member 18.

Now, Examples and Comparative Examples according to the present invention are specifically described.

[Synthesis of Ionic Group-Containing Resin]

The resin having a structure unit represented by the structural formula (1) according to the present invention can be synthesized by a known method, e.g., by subjecting a compound having a vinyl group or an acryloyl group to radical polymerization, quaternizing the resultant with an alkyl halide, and subjecting the quaternized product to an ion exchange reaction with a salt having a desired anion. An example of the synthesis method is described below.

(Synthesis of Ionic Group-Containing Resin IP-1)

(Polymerization)

Materials shown in Table 1 below were loaded into a reaction vessel mounted with a stirring device, a temperature gauge, a reflux tube, a dropping device, and a nitrogen gas-introducing tube, and were stirred at 80° C. for 3 hours. Next, 0.5 part by mass of a polymerization initiator (trade name: V-60; manufactured by Wako Pure Chemical Industries, Ltd.) was added to the mixture, and the whole was stirred at 80° C. for 1 hour.

TABLE 1

| | |
|---|---|
| Dry methanol | 80.0 parts by mass |
| Dimethylaminoethyl methacrylate as monomer 1 | 78.5 parts by mass |
| Polymerization initiator (trade name: V-60; manufactured by Wako Pure Chemical Industries, Ltd.) | 1.5 parts by mass |

(Quaternization)

Next, while the temperature of the reaction mixture was held at 80° C., 52.3 parts by mass of methyl bromide was gradually dropped as a quaternizing agent to the mixture over 10 minutes, and the whole was stirred for 2 hours.

(Anion Exchange)

Next, the reaction mixture was cooled to room temperature and 200.0 parts by mass of dichloromethane was added to the mixture. An aqueous solution prepared by dissolving 157.9 parts by mass of lithium bis(trifluoromethanesulfonyl) imide (manufactured by Wako Pure Chemical Industries, Ltd.) as an anion exchange reagent in 236.9 parts by mass of water was added to the resultant, and the mixture was stirred under room temperature for 24 hours. The organic phase of the resultant mixed solution was separated, and was washed and separated with pure water twice. Dichloromethane was distilled off under reduced pressure. Thus, an ionic group-containing resin IP-1 whose anion was a bis(trifluoromethanesulfonyl)imide was obtained.

(Synthesis of Ionic Group-Containing Resins IP-12, 13, 14, 19, 20, and 21)

Ionic group-containing resins IP-12, 13, 14, 19, 20, and 21 were obtained in the same manner as in the synthesis example of the synthesis of the ionic group-containing resin IP-1 except that the kinds and blending amounts of the monomer 1, the quaternizing agent, and the anion exchange reagent were changed as shown in Table 2.

TABLE 2

| | Monomer 1 | | Monomer 2 | | Quaternizing agent | | Anion exchange reagent | |
|---|---|---|---|---|---|---|---|---|
| No. | Chemical name | part(s) by mass | Chemical name | part(s) by mass | Chemical name | part(s) by mass | Chemical name | part(s) by mass |
| IP-1 | Dimethylaminoethyl | 78.5 | — | — | $CH_3Br$ | 52.3 | $(CF_3SO_2)_2NLi$ | 157.9 |
| IP-2 | methacrylate | 70.7 | Lauryl | 12.7 | | 47.0 | $(FSO_2)_2NLi$ | 92.6 |
| IP-3 | | | methacrylate | | | | $CF_3COOLi$ (*1) | 59.4 |
| IP-4 | | | | | | | $LiBF_4$ (*2) | 46.5 |
| IP-5 | | 39.3 | Styrene | 26.0 | $C_{12}H_{25}Br$ | 68.5 | $CF_3SO_3Li$ (*3) | 42.9 |
| IP-6 | | | | | | | $(CF_3SO_2)_3CK$ (*4) | 123.8 |
| IP-7 | | 70.7 | 2-Hydroxyethyl | 6.5 | | 123.3 | $LiPF_6$ (*5) | 75.2 |
| IP-8 | | | methacrylate | | | | $(CN)_2NNa$ (*6) | 44.1 |
| IP-9 | 3-Vinyl | 5.6 | Methyl | 45.0 | $CH_3Br$ | 10.5 | $(CF_3CF_2SO_2)_2NLi$ (*7) | 21.3 |
| IP-10 | piperidine | | methacrylate | | | | $CF_3CF_2CF_2COONa$ (*8) | 13.0 |
| IP-11 | | | | | | | $KAsF_6$ (*9) | 12.5 |
| IP-12 | 1-Methyl-2-(1- | 91.5 | — | — | | 52.3 | $CF_3SO_3Li$ | 85.8 |
| IP-13 | pyrrolidinyl | | | | | | $(CF_3SO_2)_3CK$ | 247.5 |
| IP-14 | ethyl acrylate | | | | | | $(C_2O_4)_2BLi$ (*10) | 106.7 |
| IP-15 | 4-Vinyl | 36.8 | 2-Ethylhexyl | 29.7 | $C_4H_9Br$ | 52.7 | $(CF_3SO_2)_2NLi$ | 110.5 |
| IP-16 | pyridine | | methacrylate | | | | $CF_3CF_2CF_2COONa$ | 90.9 |
| IP-17 | | | | | | | $LiBF_4$ | 36.2 |
| IP-18 | | | | | | | $LiSbF_6$ (*11) | 93.6 |
| IP-19 | 1-Allyl | 54.0 | — | — | $C_2H_5Br$ | 60.0 | $(CF_3SO_2)_2NLi$ | 157.9 |
| IP-20 | imidazole | | | | | | $(SO_2C_3F_6SO_2)_2NK$ (*12) | 182.1 |
| IP-21 | | | | | | | $CF_3SO_3Li$ | 85.8 |
| IP-22 | 1-(2- | 63.0 | Methyl | 15.0 | | 42.0 | $CF_3COOLi$ | 46.2 |
| IP-23 | Methacryloyloxyethyl)imidazole | | methacrylate | | | | $(CN_2)NNa$ | 34.3 |
| IP-24 | Dimethylaminoethyl methacrylate | 27.5 | | | | | $(CF_3SO_2)_2NLi$ | 110.5 |
| | 1-(2-Methacryloyloxyethyl)imidazole | 31.5 | | | | | | |
| IP-25 | Dimethylaminoethyl methacrylate | 78.5 | — | — | $CH_3Br$ | 52.3 | $NaClO_4$ | 67.4 |
| IP-26 | 4-Vinylpyridine | 36.8 | | | $C_4H_9Br$ | 73.4 | — | — |

(*1) Lithium trifluoroacetate; manufactured by Wako Pure Chemical Industries, Ltd.
(*2) Lithium tetrafluoroborate; manufactured by Wako Pure Chemical Industries, Ltd.
(*3) Lithium trifluoromethanesulfonate; manufactured by Wako Pure Chemical Industries, Ltd.
(*4) Potassium tris(trifluoromethanesulfonyl)methide (trade name: K-TFSM; manufactured by Central Glass Co., Ltd.)
(*5) Lithium hexafluorophosphate; manufactured by Wako Pure Chemical Industries, Ltd.
(*6) Sodium dicyanamide; manufactured by Tokyo Chemical Industry Co., Ltd.
(*7) Lithium bis(pentafluoroethanesulfonyl)imide; manufactured by Kishida Chemical Co., Ltd.
(*8) Sodium pentafluorobutyrate; manufactured by Wako Pure Chemical Industries, Ltd.
(*9) Potassium hexafluoroarsenate; manufactured by Tokyo Chemical Industry Co., Ltd.
(*10) Lithium bis(oxalato)borate (trade name: LiBOB; manufactured by BOC Sciences)
(*11) Lithium hexafluoroantimonate; manufactured by Wako Pure Chemical Industries, Ltd.
(*12) Potassium N,N-hexafluoropropane-1,3-disulfonimide (trade name: EF-N302; manufactured by Mitsubishi Materials Electronic Chemicals Co., Ltd.)

(Synthesis of Ionic Group-Containing Resin IP-2)

(Polymerization)

Materials shown in Table 3 below were loaded into a reaction vessel mounted with a stirring device, a temperature gauge, a reflux tube, a dropping device, and a nitrogen gas-introducing tube, and were stirred at 80° C. for 3 hours. Next, 0.5 part by mass of a polymerization initiator (trade name: V-60; manufactured by Wako Pure Chemical Industries, Ltd.) was added to the mixture, and the whole was stirred at 80° C. for 1 hour.

TABLE 3

| | |
|---|---|
| Dry methanol | 80.0 parts by mass |
| Dimethylaminoethyl methacrylate as monomer 1 | 70.7 parts by mass |
| Lauryl methacrylate as monomer 2 | 12.7 parts by mass |
| Polymerization initiator (trade name: V-60; manufactured by Wako Pure Chemical Industries, Ltd.) | 1.5 parts by mass |

(Quaternization)

Next, while the temperature of the reaction mixture was held at 80° C., 47.0 parts by mass of methyl bromide was gradually dropped as a quaternizing agent to the mixture over 10 minutes, and the whole was stirred for 2 hours.

(Anion Exchange)

Next, the reaction mixture was cooled to room temperature and 200.0 parts by mass of dichloromethane was added to the mixture. An aqueous solution prepared by dissolving 92.6 parts by mass of lithium bis(fluorosulfonyl)imide (manufactured by Wako Pure Chemical Industries, Ltd.) as an anion exchange reagent in 138.9 parts by mass of water was added to the resultant, and the mixture was stirred under room temperature for 24 hours. The organic phase of the resultant mixed solution was separated, and was washed and separated with pure water twice. Dichloromethane was distilled off under reduced pressure. Thus, an ionic group-containing resin IP-2 whose anion was a bis(fluorosulfonyl) imide was obtained.

(Synthesis of Ionic Group-Containing Resins IP-3 to 11, IP-15 to 18, and IP-22 and 23)

Ionic group-containing resins IP-3 to 11, IP-15 to 18, and IP-22 and 23 were obtained in the same manner as in the synthesis example of the synthesis of the ionic group-containing resin IP-2 except that the kinds and blending amounts of the monomer 1, the monomer 2, the quaternizing agent, and the anion exchange reagent were changed as shown in Table 2.

(Synthesis of Ionic Group-Containing Resin IP-24)

(Polymerization)

Materials shown in Table 4 below were loaded into a reaction vessel mounted with a stirring device, a temperature gauge, a reflux tube, a dropping device, and a nitrogen gas-introducing tube, and were stirred at 80° C. for 3 hours. Next, 0.5 part by mass of a polymerization initiator (trade name: V-60; manufactured by Wako Pure Chemical Industries, Ltd.) was added to the mixture, and the whole was stirred at 80° C. for 1 hour.

TABLE 4

| | |
|---|---|
| Dry methanol | 80.0 parts by mass |
| Dimethylaminoethyl methacrylate as monomer 1 | 27.5 parts by mass |
| 1-(2-Methacryloyloxyethyl)imidazole as monomer 1 (manufactured by The Nippon Synthetic Chemical Industry Co., Ltd.) | 31.5 parts by mass |
| Methyl methacrylate as monomer 2 | 15.0 parts by mass |
| Polymerization initiator (trade name: V-60; manufactured by Wako Pure Chemical Industries, Ltd.) | 1.5 parts by mass |

(Quaternization)

Next, while the temperature of the reaction mixture was held at 80° C., 42.0 parts by mass of ethyl bromide was gradually dropped as a quaternizing agent to the mixture over 10 minutes, and the whole was stirred for 2 hours.

(Anion Exchange)

Next, the reaction mixture was cooled to room temperature and 200.0 parts by mass of dichloromethane was added to the mixture. An aqueous solution prepared by dissolving 110.5 parts by mass of lithium bis(trifluoromethanesulfonyl) imide (manufactured by Wako Pure Chemical Industries, Ltd.) as an anion exchange reagent in 165.8 parts by mass of water was added to the resultant, and the mixture was stirred under room temperature for 24 hours. The organic phase of the resultant mixed solution was separated, and was washed and separated with pure water twice. Dichloromethane was distilled off under reduced pressure. Thus, an ionic group-containing resin IP-24 whose anion was a bis(trifluoromethanesulfonyl)imide was obtained.

(Synthesis of Ionic Group-Containing Resin IP-25)

(Polymerization)

Materials shown in Table 5 below were loaded into a reaction vessel mounted with a stirring device, a temperature gauge, a reflux tube, a dropping device, and a nitrogen gas-introducing tube, and were stirred at 80° C. for 3 hours. Next, 0.5 part by mass of a polymerization initiator (trade name: V-60; manufactured by Wako Pure Chemical Industries, Ltd.) was added to the mixture, and the whole was stirred at 80° C. for 1 hour.

TABLE 5

| | |
|---|---|
| Dry methanol | 80.0 parts by mass |
| Dimethylaminoethyl methacrylate as monomer 1 | 78.5 parts by mass |

TABLE 5-continued

| | |
|---|---|
| Polymerization initiator (trade name: V-60; manufactured by Wako Pure Chemical Industries, Ltd.) | 1.5 parts by mass |

(Quaternization)

Next, while the temperature of the reaction mixture was held at 80° C., 52.3 parts by mass of methyl bromide was gradually dropped as a quaternizing agent to the mixture over 10 minutes, and the whole was stirred for 2 hours.

(Anion Exchange)

Next, the reaction mixture was cooled to room temperature and 200.0 parts by mass of dichloromethane was added to the mixture. An aqueous solution prepared by dissolving 67.4 parts by mass of sodium perchlorate (manufactured by Kishida Chemical Co., Ltd.) as an anion exchange reagent in 236.9 parts by mass of water was added to the resultant, and the mixture was stirred under room temperature for 24 hours. The organic phase of the resultant mixed solution was separated, and was washed and separated with pure water twice. Dichloromethane was distilled off under reduced pressure. Thus, an ionic group-containing resin IP-25 whose anion was a perchlorate was obtained.

(Synthesis of Ionic Group-Containing Resin IP-26)

(Polymerization)

Materials shown in Table 6 below were loaded into a reaction vessel mounted with a stirring device, a temperature gauge, a reflux tube, a dropping device, and a nitrogen gas-introducing tube, and were stirred at 80° C. for 3 hours. Next, 0.5 part by mass of a polymerization initiator (trade name: V-60; manufactured by Wako Pure Chemical Industries, Ltd.) was added to the mixture, and the whole was stirred at 80° C. for 1 hour.

TABLE 6

| | |
|---|---|
| Dry methanol | 80.0 parts by mass |
| 4-Vinylpyridine as monomer 1 (manufactured by Wako Pure Chemical Industries, Ltd.) | 36.8 parts by mass |
| Polymerization initiator (trade name: V-60; manufactured by Wako Pure Chemical Industries, Ltd.) | 1.5 parts by mass |

(Quaternization)

Next, while the temperature of the reaction mixture was held at 80° C., 73.4 parts by mass of n-butyl bromide was gradually dropped as a quaternizing agent to the mixture over 10 minutes, and the whole was stirred for 2 hours.

Next, the reaction mixture was cooled to room temperature and then methanol was distilled off under reduced pressure. Thus, an ionic group-containing resin IP-26 whose anion was a bromide ion was obtained.

The ionic group-containing resins obtained are shown in Table 7.

TABLE 7

| | Cation unit | | Copolymerization unit | | |
|---|---|---|---|---|---|
| No. | Chemical structure | mol % | Chemical name | mol % | Anion |
| IP-1 | 2-Trimethylammonium | 100 | — | — | $(CF_3SO_2)_2N^-$ |
| IP-2 | ethyl ester | 90 | Lauryl | 10 | $(FSO_2)_2N^-$ |
| IP-3 | | | methacrylate | | $CF_3COO^-$ |
| IP-4 | | | | | $BF_4^-$ |
| IP-5 | 2-Dimethyldodecylammonium | 50 | Styrene | 50 | $CF_3SO_3^-$ |
| IP-6 | ethyl ester | | | | $(CF_3SO_2)_3C^-$ |
| IP-7 | | 90 | 2-Hydroxyethyl | 10 | $PF_6^-$ |
| IP-8 | | | methacrylate | | $(CN)_2N^-$ |
| IP-9 | 1,1-Dimethyl-3- | 10 | Methyl | 90 | $(CF_3CF_2SO_2)_2N^-$ |
| IP-10 | piperidinium | | methacrylate | | $CF_3CF_2CF_2COO^-$ |
| IP-11 | | | | | $AsF_6^-$ |
| IP-12 | 1-Methyl-2-(1-methyl-1- | 100 | — | — | $CF_3SO_3^-$ |
| IP-13 | pyrrolidinium) ethyl ester | | | | $(CF_3SO_2)_3C^-$ |
| IP-14 | | | | | $(C_2O_4)_2B^-$ |
| IP-15 | 4-(1-n-Butyl-pyridinium) | 70 | 2-Ethylhexyl | 30 | $(CF_3SO_2)_2N^-$ |
| IP-16 | | | methacrylate | | $CF_3CF_2CF_2COO^-$ |
| IP-17 | | | | | $BF_4^-$ |
| IP-18 | | | | | $SbF_6^-$ |
| IP-19 | 3-(1-Ethyl-imidazolium methyl) | 100 | — | — | $(CF_3SO_2)_2N^-$ |
| IP-20 | | | | | $(SO_2C_3F_6SO_2)_2N^-$ |
| IP-21 | | | | | $CF_3SO_3^-$ |
| IP-22 | 2-(1-Ethyl-3-imidazolium) | 70 | Methyl | 30 | $CF_3COO^-$ |
| IP-23 | ethyl ester | | methacrylate | | $(CN_2)N^-$ |
| IP-24 | 2-Dimethylethylammonium | 35 | | | $(CF_3SO_2)_2N^-$ |
| | ethyl ester | | | | |
| | 2-(1-Ethyl-3-imidazolium) | 35 | | | |
| | ethyl ester | | | | |
| IP-25 | 2-Trimethylammonium | 100 | — | — | $ClO_4^-$ |
| | ethyl ester | | | | |
| IP-26 | 4-(1-n-Butyl-pyridinium) | 100 | | | $Br^-$ |

(Preparation of Mandrel 2)

Prepared as the mandrel 2 as the substrate according to the present invention was a product obtained by applying and baking a primer (trade name: DY35-051; manufactured by Dow Corning Toray Co., Ltd.) to a cored bar made of SUS304 having a diameter of 6 mm.

(Production of Elastic Roller)

[Production of Silicone Rubber Elastic Roller]

The mandrel 2 prepared in the foregoing was placed in a mold, and an addition-type silicone rubber composition obtained by mixing materials shown in Table 8 below was injected into a cavity formed in the mold.

TABLE 8

| | |
|---|---|
| Liquid silicone rubber material (trade name: SE6724A/B; manufactured by Dow Corning Toray Co., Ltd.) | 100.0 parts by mass |
| Carbon black (trade name: TOKABLACK #4300; manufactured by Tokai Carbon Co., Ltd.) | 15.0 parts by mass |
| Platinum catalyst | 0.1 part by mass |

Subsequently, the mold was heated, and the silicone rubber composition was vulcanized and cured at a temperature of 150° C. for 15 minutes. The mandrel having a cured silicone rubber layer formed on its peripheral surface was removed from the mold, and then the curing reaction of the silicone rubber layer was completed by further heating the mandrel at a temperature of 180° C. for 1 hour. Thus, an elastic roller D-1 in which a silicone rubber elastic layer having a diameter of 12 mm had been formed on the outer periphery of the mandrel 2 was produced.

[Production of NBR Rubber Elastic Roller]

<1. Preparation of Unvulcanized Rubber Composition>

Respective materials whose kinds and amounts were shown in Table 9 below were mixed with a pressure-type kneader to provide an A kneaded rubber composition.

TABLE 9

| | |
|---|---|
| NBR rubber (trade name: Nipol DN219; manufactured by Zeon Corporation) | 100.0 parts by mass |
| Carbon black (trade name: TOKABLACK #4300; manufactured by Tokai Carbon Co., Ltd.) | 40.0 parts by mass |
| Calcium carbonate (trade name: Nanox #30; manufactured by Maruo Calcium Co., Ltd.) | 20.0 parts by mass |
| Stearic acid (trade name: Stearic acid S; manufactured by Kao Corporation) | 1.0 part by mass |

Further, 166.0 parts by mass of the A kneaded rubber composition, and respective materials whose kinds and amounts were shown in Table 10 below were mixed with an open roll to prepare an unvulcanized rubber composition.

TABLE 10

| | |
|---|---|
| Sulfur (trade name: Sulfax 200S; manufactured by Tsurumi Chemical Industry Co., Ltd.) | 1.2 parts by mass |
| Tetrabenzylthiuram disulfide (trade name: TBZTD; manufactured by Sanshin Chemical Industry Co., Ltd.) | 4.5 parts by mass |

Next, a crosshead extruder having a mechanism for supplying an electro-conductive mandrel and a mechanism for discharging an unvulcanized rubber roller was prepared. A die having an inner diameter of 16.5 mm was attached to a crosshead, and the temperature of the crosshead extruder and the speed at which the electro-conductive mandrel was conveyed were adjusted to 80° C. and 60 mm/second, respectively. Under the foregoing conditions, the unvulcanized rubber composition was supplied from the extruder, and in the crosshead, the peripheral surface of the electro-conductive mandrel 2 prepared in the foregoing was covered with the unvulcanized rubber composition as an unvulcanized rubber layer. Thus, an unvulcanized rubber roller was obtained. Next, the unvulcanized rubber roller was loaded into a hot-air vulcanizing furnace at 170° C. and heated for 60 minutes to provide an unpolished electro-conductive roller. After that, the end portions of a NBR rubber elastic layer obtained by vulcanizing the unvulcanized rubber layer were cut and removed, and the surface of the NBR rubber elastic layer was polished with a rotary grindstone. Thus, an elastic roller D-2 in which each of diameters at positions distant from its central portion toward both end portions by 90 mm each was 8.4 mm and a diameter at the central portion was 8.5 mm was produced.

(Preparation of Surface Layer 4)

[Synthesis of Isocyanate Group-terminated Prepolymer]

(Synthesis of Isocyanate Group-terminated Prepolymer B-1)

Under a nitrogen atmosphere, as shown in Table 11, 100.0 parts by mass of a polypropylene glycol-based polyol (trade name: EXCENOL 230; manufactured by Asahi Glass Co., Ltd.) was gradually dropped to 21.7 parts by mass of tolylene diisocyanate (TDI) (trade name: COSMONATE T80; manufactured by Mitsui Chemicals, Inc.) in a reaction vessel while a temperature in the reaction vessel was held at 65° C.

After the completion of the dropping, the mixture was subjected to a reaction at a temperature of 65° C. for 2 hours, and 52.2 parts by mass of methyl ethyl ketone was added to the resultant. The resultant reaction mixture was cooled to room temperature to provide an isocyanate group-terminated urethane prepolymer B-1 having an isocyanate group content of 5.10 wt %.

(Synthesis of Isocyanate Group-Terminated Prepolymer B-2)

Under a nitrogen atmosphere, as shown in Table 11, 100.0 parts by mass of a polybutylene adipate-based polyol (trade name: NIPPOLLAN 4010; manufactured by Nippon Polyurethane Industry Co., Ltd.) was gradually dropped to 33.8 parts by mass of polymeric MDI (trade name: MILLIONATE MR; manufactured by Nippon Polyurethane Industry Co., Ltd.) in a reaction vessel while a temperature in the reaction vessel was held at 65° C.

After the completion of the dropping, the mixture was subjected to a reaction at a temperature of 65° C. for 2 hours, and 57.3 parts by mass of methyl ethyl ketone was added to the resultant. The resultant reaction mixture was cooled to room temperature to provide an isocyanate group-terminated urethane prepolymer B-2 having an isocyanate group content of 4.60 wt %.

(Synthesis of Isocyanate Group-Terminated Prepolymer B-3)

Under a nitrogen atmosphere, as shown in Table 11, 100.0 parts by mass of a polypropylene glycol-based polyol (trade name: EXCENOL 230; manufactured by Asahi Glass Co., Ltd.) was gradually dropped to 33.8 parts by mass of polymeric MDI (trade name: MILLIONATE MR; manufactured by Nippon Polyurethane Industry Co., Ltd.) in a reaction vessel while a temperature in the reaction vessel was held at 65° C.

After the completion of the dropping, the mixture was subjected to a reaction at a temperature of 65° C. for 2 hours, and 57.3 parts by mass of methyl ethyl ketone was added to the resultant. The resultant reaction mixture was cooled to room temperature to provide an isocyanate group-terminated urethane prepolymer B-3 having an isocyanate group content of 4.80 wt %.

TABLE 11

| | Kind of isocyanate | Modification component | Effective NCO % |
|---|---|---|---|
| B-1 | TDI | Trifunctional polypropylene glycol | 5.10% |
| B-2 | polymeric MDI | Bifunctional polybutylene adipate | 4.60% |
| B-3 | | Trifunctional polypropylene glycol | 4.80% |

Example 1

A method of producing the electrophotographic member of the invention of the present application is described below.

Materials shown in Table 12 below were stirred and mixed as materials for the surface layer 4.

TABLE 12

| | |
|---|---|
| Polypropylene glycol-based polyol (trade name: EXCENOL 230; manufactured by Asahi Glass Co., Ltd.) | 59.2 parts by mass |
| Isocyanate group-terminated prepolymer B-1 | 58.4 parts by mass |
| Ionic group-containing resin IP-1 | 5.0 parts by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

Next, methyl ethyl ketone was added to the mixture so that a total solid content ratio became 30 mass %. After that, the contents were mixed with a sand mill. Next, the viscosity of the mixture was further adjusted to from 10 cps to 13 cps with methyl ethyl ketone. Thus, a paint 1 for forming a surface layer was prepared.

A coating film of the paint 1 for forming a surface layer was formed on the surface of the elastic layer of the elastic roller D-1 produced in advance by immersing the elastic roller D-1 in the paint, and was dried. Further, a surface layer having a thickness of 15 μm was formed on the outer periphery of the elastic layer by subjecting the resultant to a heat treatment at a temperature of 150° C. for 1 hour. Thus, an electro-conductive roller as an electrophotographic member according to Example 1 was produced.

The fact that the surface layer according to the present invention has the structure of the structural formula (1) can be confirmed by, for example, analysis based on pyrolysis GC/MS, FT-IR, or NMR.

The resin IP-1 obtained in this synthesis example was analyzed by using a pyrolyzer (trade name: PYROFOIL SAMPLER JPS-700, manufactured by Japan Analytical Industry Co., Ltd.) and a GC/MS apparatus (trade name: Focus GC/ISQ, manufactured by Thermo Fischer Scientific K.K.), and helium as a carrier gas at a pyrolysis temperature of 590° C. As a result, it was confirmed from the resultant fragment peak that the surface layer had the structure of the structural formula (1).

The electro-conductive roller according to Example 1 thus obtained was evaluated for the following items.

<Evaluation for Fluctuation in Roller Resistance Value>

The electro-conductive roller left to stand in an environment having a temperature of 30° C. and a humidity of 80% RH for 6 hours or more was used in the measurement of a roller resistance value.

(Measurement of Initial Roller Resistance)

Figure 4A:
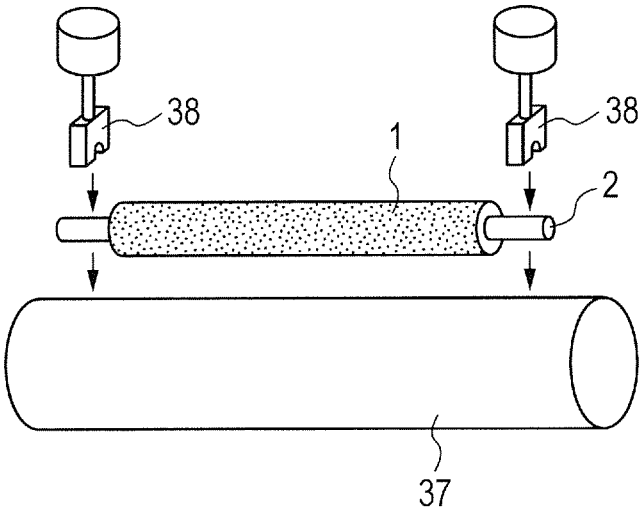
FIG. 4A and FIG. 4B are each a schematic construction view of a jig for evaluating a fluctuation in roller resistance value according to the present invention.
Figure 4B:
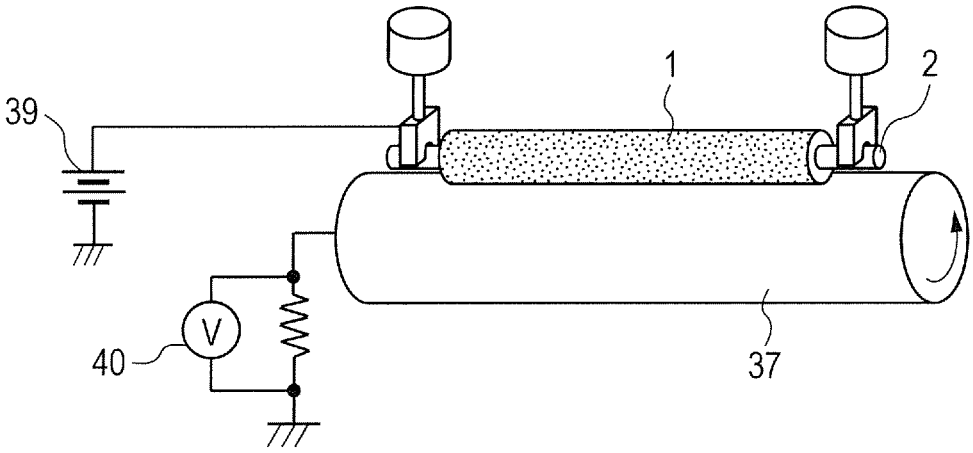

FIG. 4A and FIG. 4B are schematic construction views for illustrating a jig for evaluating a fluctuation in roller resistance value. As illustrated in FIG. 4A, in the environment having a temperature of 30° C. and a humidity of 80% RH, a columnar metal 37 having a diameter of 24 mm was rotated at a surface speed of 50 mm/second while both ends of the electro-conductive mandrel 2 were each pressed at a load of 4.9 N through an electro-conductive bearing 38. Thus, the electro-conductive roller 1 was caused to rotate following the rotation of the mandrel. Next, in FIG. 4B, a voltage of 50 V was applied from a high-voltage power source 39, and a potential difference across a resistor having a known electrical resistance (the electrical resistance was two or more orders of magnitude lower than the electrical resistance of the electro-conductive roller), the resistor being placed between the columnar metal 37 and the ground, was measured. A voltmeter 40 (189 TRUE RMS MULTIMETER manufactured by Fluke Corporation) was used in the measurement of the potential difference. A current that had flowed in the columnar metal through the electro-conductive roller 1 was determined from the measured potential difference and the electrical resistance of the resistor by calculation. The electrical resistance value of the electro-conductive roller 1 was determined by dividing the applied voltage of 50 V by the resultant current.

Here, in the measurement of the potential difference, 2 seconds after the application of the voltage, sampling was performed for 3 seconds and a value calculated from the average of the sampled data was defined as an initial roller resistance value.

(Measurement of Roller Resistance after Electrification)

After the measurement of the initial roller resistance value, in the environment having a temperature of 30° C. and a humidity of 80% RH, a current of 100 μA was continuously flowed for 2 hours while the same electro-conductive roller was rotated as it was at a surface speed of 50 mm/second. Two hours after that, a roller resistance after the electrification was measured in the same manner as in the measurement of the initial roller resistance value.

(Electrification Deterioration)

A value (roller resistance value after electrification/initial roller resistance value) obtained by dividing the roller resistance value after the electrification by the initial roller resistance value was used as an indicator of electrification deterioration.

[Evaluation for Ghost]

Next, the electro-conductive roller whose resistance after the electrification had been measured as described above was left to stand in an environment having a temperature of 15° C. and a humidity of 10% RH (hereinafter referred to as "L/L") for 6 hours or more, and was then subjected to the following evaluation.

A laser printer having a construction illustrated in FIG. 3 (trade name: LBP7700C; manufactured by Canon Inc.) was placed in the L/L environment, and the electro-conductive roller as the electrophotographic member according to this example was loaded as a developing roller, followed by an evaluation for a ghost image.

That is, as an image pattern, a 15-mm square solid black image was printed at a tip portion in one sheet by using a black toner, and then an entire halftone image was printed on the sheet by using the toner. Next, the non-uniform density of the period of the developing roller as a toner carrier appearing in a halftone portion was visually evaluated, and the evaluation for a ghost was performed by the following criteria.

(Criteria for Evaluation for Ghost Under L/L Environment)

A: No ghost is observed.

B: An extremely slight ghost is observed.

C: A remarkable ghost is observed.

TABLE 13

| | Ionic group-containing resin | | Polyol | | Curing agent | |
|---|---|---|---|---|---|---|
| | No. | part(s) by mass | No. | part(s) by mass | No. | part(s) by mass |
| Example 1 | IP-1 | 5.0 | EXCENOL 230 | 59.2 | B-1 | 58.4 |
| Example 2 | IP-2 | | | | | |
| Example 3 | IP-3 | | | | | |
| Example 4 | IP-4 | | | | | |
| Example 5 | IP-5 | | | 80.0 | U-VAN 20SB | 40.0 |
| Example 6 | IP-6 | | | | | |
| Example 7 | IP-7 | | | | | |
| Example 8 | IP-8 | | | | | |
| Example 9 | IP-9 | | NIPPOLLAN 4010 | 56.6 | B-2 | 61.9 |
| Example 10 | IP-10 | | | | | |
| Example 11 | IP-11 | | | | | |
| Example 12 | IP-12 | | | | | |
| Example 13 | IP-13 | | | | | |
| Example 14 | IP-14 | | | | | |
| Example 15 | IP-15 | 2.0 | PTG 2000 | 57.7 | B-3 | 60.5 |
| Example 16 | IP-16 | | | | | |
| Example 17 | IP-17 | | | | | |
| Example 18 | IP-18 | | | | | |
| Example 19 | IP-19 | | | | | |

TABLE 13-continued

| | Ionic group-containing resin | | Polyol | | Curing agent | |
|---|---|---|---|---|---|---|
| | No. | part(s) by mass | No. | part(s) by mass | No. | part(s) by mass |
| Example 20 | IP-20 | | | | | |
| Example 21 | IP-21 | | | | | |
| Example 22 | IP-22 | | EXCENOL 500ED | 15.5 | | 120.7 |
| Example 23 | IP-23 | | | | | |
| Example 24 | IP-24 | | | | | |
| Example 25 | IP-19 | | PTG 2000 | 57.7 | | 60.5 |
| Comparative Example 1 | EMIM/TFSI | 1.0 | NIPPOLLAN 4010 | 56.6 | B-2 | 61.9 |
| Comparative Example 2 | EMIM/BF4 | | | | | |
| Comparative Example 3 | IP-25 | 2.0 | | | | |
| Comparative Example 4 | IP-26 | 5.0 | | | | |
| Comparative Example 5 | EMIM/TFSI | 1.0 | | | | |

Examples 2 to 4

Electrophotographic members of Examples 2 to 4 were produced in the same manner as in Example 1 except that the ionic group-containing resin was changed as shown in Table 13.

Example 5

Materials shown in Table 14 below were stirred and mixed.

TABLE 14

| | |
|---|---|
| Polypropylene glycol-based polyol (trade name: EXCENOL 230; manufactured by Asahi Glass Co., Ltd.) | 80.0 parts by mass |
| Melamine resin (trade name: U-VAN 20SB; manufactured by Mitsui Chemicals, Inc.) | 40.0 parts by mass |
| Ionic group-containing resin IP-5 | 5.0 parts by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

Next, methyl ethyl ketone was added to the mixture so that a total solid content ratio became 30 mass %. After that, the contents were mixed with a sand mill. Next, the viscosity of the mixture was further adjusted to from 10 cps to 13 cps with methyl ethyl ketone. Thus, a paint 5 for forming a surface layer was prepared.

A coating film of the paint 5 for forming a surface layer was formed on the surface of the elastic layer of the elastic roller D-1 produced in advance by immersing the elastic roller D-1 in the paint, and was dried. Further, a surface layer having a thickness of 15 μm was formed on the outer periphery of the elastic layer by subjecting the resultant to a heat treatment at a temperature of 140° C. for 30 minutes. Thus, an electro-conductive roller as an electrophotographic member according to Example 5 was produced.

Examples 6 to 8

Electrophotographic members of Examples 6 to 8 were produced in the same manner as in Example 5 except that the ionic group-containing resin was changed as shown in Table 13.

Example 9

Materials shown in Table 15 below were stirred and mixed.

TABLE 15

| | |
|---|---|
| Polybutylene adipate-based polyol (trade name: NIPPOLLAN 4010; manufactured by Nippon Polyurethane Industry Co., Ltd.) | 56.6 parts by mass |
| Isocyanate group-terminated prepolymer B-2 | 61.9 parts by mass |
| Ionic group-containing resin IP-9 | 5.0 parts by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

The subsequent steps were performed in the same manner as in Example 1. Thus, an electrophotographic member of Example 9 was produced.

Examples 10 to 14

Electrophotographic members of Examples 10 to 14 were produced in the same manner as in Example 9 except that the ionic group-containing resin was changed as shown in Table 13.

Example 15

Materials shown in Table 16 below were stirred and mixed.

TABLE 16

| | |
|---|---|
| Polytetramethylene glycol-based polyol (trade name: PTG2000; manufactured by Hodogaya Chemical Co., Ltd.) | 57.7 parts by mass |
| Isocyanate group-terminated prepolymer B-3 | 60.5 parts by mass |
| Ionic group-containing resin IP-15 | 2.0 parts by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

The subsequent steps were performed in the same manner as in Example 1. Thus, an electrophotographic member of Example 15 was produced.

Examples 16 to 21

Electrophotographic members of Examples 16 to 21 were produced in the same manner as in Example 15 except that the ionic group-containing resin was changed as shown in Table 13.

Example 22

Materials shown in Table 17 below were stirred and mixed.

TABLE 17

| | |
|---|---|
| Ethylenediamine-based polyol (trade name: EXCENOL 500ED; manufactured by Asahi Glass Co., Ltd.) | 15.5 parts by mass |
| Isocyanate group-terminated prepolymer B-3 | 120.7 parts by mass |
| Ionic group-containing resin IP-22 | 2.0 parts by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

The subsequent steps were performed in the same manner as in Example 1. Thus, an electrophotographic member of Example 22 was produced.

Examples 23 and 24

Electrophotographic members of Examples 23 and 24 were produced in the same manner as in Example 22 except that the ionic group-containing resin was changed as shown in Table 13.

Example 25

Materials shown in Table 18 below were stirred and mixed.

TABLE 18

| | |
|---|---|
| Polytetramethylene glycol-based polyol (trade name: PTG2000; manufactured by Hodogaya Chemical Co., Ltd.) | 57.7 parts by mass |
| Isocyanate group-terminated prepolymer B-3 | 60.5 parts by mass |
| Ionic group-containing resin IP-19 | 2.0 parts by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

Next, methyl ethyl ketone was added to the mixture so that a total solid content ratio became 30 mass %. After that, the contents were mixed with a sand mill. Next, the viscosity of the mixture was further adjusted to from 10 cps to 13 cps with methyl ethyl ketone. Thus, a paint 25 for forming a surface layer was prepared.

A coating film of the paint 25 for forming a surface layer was formed on the surface of the elastic layer of the elastic roller D-2 produced in advance by immersing the elastic roller D-2 in the paint, and was dried. Further, a surface layer having a thickness of 15 μm was formed on the outer periphery of the elastic layer by subjecting the resultant to a heat treatment at a temperature of 150° C. for 1 hour. Thus, an electrophotographic member according to Example 25 was produced.

Comparative Example 1

Materials shown in Table 19 below were stirred and mixed.

TABLE 19

| | |
|---|---|
| Polybutylene adipate-based polyol (trade name: NIPPOLLAN 4010; manufactured by Nippon Polyurethane Industry Co., Ltd.) | 56.6 parts by mass |
| Isocyanate group-terminated prepolymer B-2 | 61.9 parts by mass |
| 1-Ethyl-3-methylimidazolium bis(trifluoromethanesulfonyl)imide as ionic liquid (manufactured by Sigma-Aldrich Co. LLC.) | 1.0 part by mass |
| Silica (trade name: AEROSIL200; manufactured by Nippon Aerosil Co., Ltd.) | 15.0 parts by mass |
| Urethane resin fine particles (trade name: Art-pearl C-400; manufactured by Negami Chemical Industrial Co., Ltd.) | 10.0 parts by mass |

The subsequent steps were performed in the same manner as in Example 1. Thus, an electrophotographic member of Comparative Example 1 was produced.

Comparative Example 2

An electrophotographic member of Comparative Example 2 was produced in the same manner as in Comparative Example 1 except that the ionic liquid was changed to 1-ethyl-3-methylimidazolium tetrafluoroborate (manufactured by Sigma-Aldrich Co. LLC.).

Comparative Examples 3 and 4

Electrophotographic members of Comparative Examples 3 and 4 were produced in the same manner as in Example 9 except that the ionic group-containing resin was changed as shown in Table 13.

Comparative Example 5

An electrophotographic member of Comparative Example 5 was produced in the same manner as in Example 25 except that the paint 25 for forming a surface layer of Comparative Example 1 was used as a raw material for the surface layer 4.

The respective electrophotographic members according to Examples 2 to 24 and Comparative Examples 1 to 4 were evaluated in the same manner as in Example 1. The results are shown in Table 20.

TABLE 20

| | Ionic group-containing resin | Cationic organic group | Anion | Initial roller resistance (Ω) | Roller resistance after electrification (Ω) | Electrification deterioration | Ghost |
|---|---|---|---|---|---|---|---|
| Example 1 | IP-1 | Trimethylammonium | $(CF_3SO_2)_2N-$ | $2.5 \times 10^7$ | $3.6 \times 10^7$ | 1.44 | A |
| Example 2 | IP-2 | | $(FSO_2)_2N^-$ | $2.1 \times 10^7$ | $3.0 \times 10^7$ | 1.43 | A |
| Example 3 | IP-3 | | $CF_3COO-$ | $3.2 \times 10^7$ | $4.8 \times 10^7$ | 1.50 | A |
| Example 4 | IP-4 | | $BF_4-$ | $3.5 \times 10^7$ | $4.8 \times 10^7$ | 1.37 | A |
| Example 5 | IP-5 | Dimethyldodecylammonium | $CF_3SO_3-$ | $2.1 \times 10^7$ | $2.8 \times 10^7$ | 1.33 | A |
| Example 6 | IP-6 | | $(CF_3SO_2)_3C-$ | $5.7 \times 10^7$ | $8.2 \times 10^7$ | 1.44 | B |
| Example 7 | IP-7 | | $PF_6-$ | $2.4 \times 10^7$ | $3.6 \times 10^7$ | 1.50 | A |
| Example 8 | IP-8 | | $(CN)_2N-$ | $1.8 \times 10^7$ | $2.5 \times 10^7$ | 1.39 | A |
| Example 9 | IP-9 | 1,1-Dimethyl-piperidinium | $(CF_3CF_2SO_2)_2N-$ | $6.2 \times 10^7$ | $9.4 \times 10^7$ | 1.52 | B |
| Example 10 | IP-10 | | $CF_3CF_2CF_2COO-$ | $6.8 \times 10^7$ | $8.4 \times 10^7$ | 1.24 | B |
| Example 11 | IP-11 | | $AsF_6-$ | $5.7 \times 10^7$ | $9.0 \times 10^7$ | 1.58 | B |
| Example 12 | IP-12 | 1-Methyl-pyrrolidinium | $CF_3SO_3-$ | $7.2 \times 10^7$ | $9.8 \times 10^7$ | 1.36 | B |
| Example 13 | IP-13 | | $(CF_3SO_2)_3C-$ | $1.8 \times 10^7$ | $2.5 \times 10^7$ | 1.39 | A |
| Example 14 | IP-14 | | $(C_2O_4)_2B-$ | $5.7 \times 10^7$ | $8.3 \times 10^7$ | 1.46 | B |
| Example 15 | IP-15 | 1-n-Butyl-pyridinium | $(CF_3SO_2)_2N-$ | $3.7 \times 10^6$ | $4.0 \times 10^6$ | 1.08 | A |
| Example 16 | IP-16 | | $CF_3CF_2CF_2COO-$ | $3.8 \times 10^6$ | $4.2 \times 10^6$ | 1.11 | A |
| Example 17 | IP-17 | | $BF_4-$ | $7.1 \times 10^6$ | $9.1 \times 10^6$ | 1.28 | A |
| Example 18 | IP-18 | | $SbF_6-$ | $6.0 \times 10^6$ | $6.1 \times 10^6$ | 1.02 | A |
| Example 19 | IP-19 | 1-Ethyl-imidazolium | $(CF_3SO_2)_2N-$ | $1.6 \times 10^5$ | $1.8 \times 10^5$ | 1.13 | A |
| Example 20 | IP-20 | | $(SO_2C_3F_6SO_2)_2N-$ | $9.1 \times 10^5$ | $1.1 \times 10^6$ | 1.21 | A |
| Example 21 | IP-21 | | $CF_3SO_3-$ | $2.6 \times 10^5$ | $2.7 \times 10^5$ | 1.04 | A |
| Example 22 | IP-22 | | $CF_3COO-$ | $4.8 \times 10^5$ | $5.6 \times 10^5$ | 1.17 | A |
| Example 23 | IP-23 | | $(CN_2)N-$ | $3.7 \times 10^6$ | $4.2 \times 10^6$ | 1.14 | A |
| Example 24 | IP-24 | Dimethylethylammonium, 1-ethyl-imidazolium | $(CF_3SO_2)_2N-$ | $3.3 \times 10^6$ | $3.6 \times 10^6$ | 1.09 | A |
| Comparative Example 1 | EMIM/TFSI | 1-Ethyl-3-methylimidazolium | $(CF_3SO_2)_2N-$ | $6.4 \times 10^8$ | $7.9 \times 10^9$ | 12.34 | C |
| Comparative Example 2 | EMIM/BF4 | | $BF_4-$ | $5.6 \times 10^8$ | $8.3 \times 10^9$ | 14.82 | C |
| Comparative Example 3 | IP-25 | Trimethylammonium | $ClO_4-$ | $3.6 \times 10^8$ | $1.6 \times 10^9$ | 4.44 | C |
| Comparative Example 4 | IP-26 | 1-n-Butyl-pyridinium | Br | $2.1 \times 10^9$ | $6.6 \times 10^9$ | 3.14 | C |

Next, the electrophotographic members according to Example 25 and Comparative Example 5 thus obtained were each subjected to the evaluation for a fluctuation in roller resistance value. Further, each of those members was used as a charging roller and evaluated for the following item.

<Evaluation for Horizontal Streak Image>

A fine streak-like non-uniform density (horizontal streak) may occur in a halftone image owing to a change in electro-conductivity (increase in electrical resistance) of a charging roller due to electrification. The resultant image is called a horizontal streak image. The horizontal streak image tends to occur to a larger extent as the electro-conductivity of the charging roller changes, and the image tends to be conspicuous in association with long-term utilization of an electrophotographic apparatus. The electrophotographic member of the present invention was incorporated as the charging roller into the electrophotographic apparatus, and the following evaluation was performed.

The electro-conductive rollers obtained in Example 25 and Comparative Example 5 were each mounted as the charging roller of an electrophotographic laser printer (trade name: HP Color Laserjet Enterprise CP4515dn, manufactured by Hewlett-Packard Company) as the electrophotographic apparatus. Then, an endurance test in which an image having a print density of 4% (such an image that horizontal lines each having a width of 2 dots were drawn in a direction vertical to the rotation direction of a photosensitive member at an interval of 50 dots) was continuously output was performed. In addition, after the image had been continuously output on 24,000 sheets, a halftone image (such an image that horizontal lines each having a width of 1 dot were drawn in the direction vertical to the rotation direction of the photosensitive member at an interval of 2 dots) was output for an image check. The resultant image was visually observed and a fine streak-like non-uniform density (horizontal streak) was evaluated. The results of the evaluation are shown in Table 21.

A: The level at which no horizontal streak occurs.

B: The level at which a horizontal streak slightly occurs only in an end portion of the image.

C: The level at which a horizontal streak occurs in a substantially half region of the image and is conspicuous.

TABLE 21

| | Ionic group-containing resin | Cationic organic group | Anion | Initial roller resistance (Ω) | Roller resistance after electrification (Ω) | Electrification deterioration | Horizontal streak |
|---|---|---|---|---|---|---|---|
| Example 25 | IP-19 | 1-Ethyl-imidazolium | $(CF_3SO_2)_2N^-$ | $8.7 \times 10^5$ | $1.1 \times 10^6$ | 1.26 | A |
| Comparative Example 5 | EMIM/TFSI | 1-Ethyl-3-methylimidazolium | | $3.9 \times 10^8$ | $6.3 \times 10^9$ | 16.15 | C |

Each of the electrophotographic members produced in Examples 1 to 25 shows a small increase in resistance due to electrification under a high-temperature and high-humidity environment, and maintains good image quality after an electrification test occurs, because the surface layer as an electro-conductive layer according to the present invention contains the resin having a structure unit represented by the structural formula (1) according to the present invention, and at least one anion selected from the group consisting of a fluorinated sulfonylimide anion, a fluorinated sulfonylmethide anion, a fluorinated sulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato) borate anion.

In particular, an increase in resistance of each of Examples 15 to 25 in each of which the resin having a structure unit represented by the structural formula (1) has an imidazolium group or a pyridinium group as a cationic organic group is suppressed at an additionally high level.

In contrast, in each of Comparative Examples 1 and 2, and Comparative Example 5 each containing a monomolecular ionic liquid, and Comparative Examples 3 and 4 each of which is free of the anion according to the present invention, a significant increase in resistance due to electrification under a high-temperature and high-humidity environment is observed, and a harmful effect on an image after an electrification test occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-102654, filed May 16, 2014, which is hereby incorporated by reference herein in its entirety.

What is claimed is:

1. An electrophotographic member, comprising:

a substrate; and an electro-conductive layer, the electro-conductive layer comprising a binder resin, an anion and a resin having a structure unit represented by formula (1)

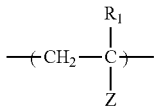

(1)

where $R_1$ represents a hydrogen atom or a methyl group, and Z represents a cationic organic group, wherein said anion is at least one member selected from the group consisting of a fluorinated sulfonylimide anion, a fluorinated sulfonylmethide anion, a fluorinated sulfonate anion, a fluorinated carboxylate anion, a fluorinated borate anion, a fluorinated phosphate anion, a fluorinated arsenate anion, a fluorinated antimonate anion, a dicyanamide anion and a bis(oxalato)borate anion, and a content of the resin having a structure unit represented by formula (1) is 1 to 10 parts by mass with respect to 100 parts by mass of the binder resin.

2. An electrophotographic member according to claim 1, wherein the cationic organic group Z comprises at least one member selected from the group consisting of an imidazolium group and a pyridinium group.

3. An electrophotographic member according to claim 1, wherein a number-average molecular weight of the resin having a structure unit represented by formula (1) is 2,000 to 70,000.

4. A process cartridge, which is removably mounted onto a main body of an electrophotographic apparatus, the process cartridge comprising:

a charging member; and a developer carrying member, wherein at least one of the charging member or the developer carrying member comprises the electrophotographic member of claim 1.

5. An electrophotographic apparatus, comprising:

an electrophotographic photosensitive member;

a charging member; and a developer carrying member, wherein at least one of the charging member or the developer carrying member comprises the electrophotographic member of claim 1.

6. An electrophotographic member according to claim 1, wherein the binder resin comprises at least one of a polyurethane resin, a polyester resin, a polyether resin, an acrylic resin, an epoxy resin or an amino resin.

* * * * *